US011345149B2

(12) United States Patent
Komuro

(10) Patent No.: US 11,345,149 B2
(45) Date of Patent: May 31, 2022

(54) INK JET RECORDING HEAD AND INK JET RECORDING APPARATUS

(71) Applicant: CANON KABUSHIKI KAISHA, Tokyo (JP)

(72) Inventor: Hirokazu Komuro, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/984,832

(22) Filed: Aug. 4, 2020

(65) Prior Publication Data

US 2021/0039388 A1 Feb. 11, 2021

(30) Foreign Application Priority Data

Aug. 9, 2019 (JP) ..... JP2019-147529

(51) Int. Cl.
*B41J 2/14* (2006.01)
*B41J 2/165* (2006.01)

(52) U.S. Cl.
CPC ..... *B41J 2/14072* (2013.01); *B41J 2/1433* (2013.01); *B41J 2/16535* (2013.01); *B41J 2002/14491* (2013.01)

(58) Field of Classification Search
CPC ... B41J 2/14072; B41J 2/1433; B41J 2/16535
See application file for complete search history.

(56) References Cited

U.S. PATENT DOCUMENTS

2006/0017774 A1* 1/2006 Beak ..... B41J 2/14072 347/44
2007/0008375 A1* 1/2007 Tanikawa ..... B41J 2/1625 347/50
2008/0239010 A1* 10/2008 Tomita ..... B41J 2/1632 347/58

FOREIGN PATENT DOCUMENTS

| | | | |
|---|---|---|---|
| CN | 1724257 | A | 1/2006 |
| CN | 101076449 | A | 11/2007 |
| CN | 101607473 | A | 12/2009 |
| CN | 101920596 | A | 12/2010 |
| CN | 108501530 | A | 9/2018 |
| JP | H07276643 | A | 10/1995 |
| JP | 2001138520 | A | 5/2001 |
| JP | 2010004050 | A | 1/2010 |
| JP | 2010208268 | A | 9/2010 |

* cited by examiner

*Primary Examiner* — Jason S Uhlenhake
(74) *Attorney, Agent, or Firm* — Canon U.S.A., Inc. IP Division

(57) ABSTRACT

An ink jet recording head includes an ejection chip in which a plurality of ejection orifices performing ejection are arranged; an external wiring board including an external wiring for applying an electric signal to the ejection chip from an outside; an electrical bonding portion where the external wiring of the external wiring board and the ejection chip are electrically bonded to each other; and a resin sealing portion that seals the electrical bonding portion, in which a corner of the external wiring board where a first end surface on an ejection chip side and a side end surface connected to the first end surface intersect has a chamfered portion which is chamfered, and the chamfered portion is positioned within a width of the ejection chip in an ejection orifice arrangement direction.

18 Claims, 17 Drawing Sheets

INK JET RECORDING HEAD AND INK JET RECORDING APPARATUS

BACKGROUND OF THE DISCLOSURE

Field of the Disclosure

The present disclosure relates to an ink jet recording head and an ink jet recording apparatus for performing recording by ejecting ink.

Description of the Related Art

An ink jet recording head includes an ejection chip in which pressure-generating elements, electric wirings, extraction electrode pads, nozzles, and ejection orifices are formed on a substrate in order to eject ink by an electric signal. Further, an external wiring board is electrically mounted on the ejection chip in order to apply an electric signal to the ejection chip from the outside.

Japanese Patent Application Laid-Open No. H07-276643 describes an ink jet recording head having an ejection chip in which an electrode pad row is arranged in the same direction as an ejection orifice row. In this ejection chip, the electrode pad row is disposed in a region shorter than the width of the ejection chip in an ejection orifice arrangement direction.

Japanese Patent Application Laid-Open No. 2001-438520 describes an ink jet recording head in which an ejection chip and an external wiring board are electrically mounted. As the electrical mounting, it is described that a bump is formed on the electrode pad, and the wiring of the external wiring board and the bump are electrically bonded by anisotropic conductive film (ACF).

Japanese Patent Application Laid-Open No. 2010-4050 describes that a semiconductor chip and an external wiring board are electrically bonded via bumps, and electrical bonding portion is sealed by a resin sealing material.

Japanese Patent Application Laid-Open No. 2010-208268 describes an ink jet recording apparatus that cleans an ejection face surface by wiping an ink jet recording head.

The ink jet recording head in the related art which is provided with the above-described ejection chip and external wiring board has the following problems. The problems of the technique in the related art will be described with the ink jet recording head in the related art illustrated in FIGS. 13, 14A, and 14B as an example.

In the ejection chip, pressure-generating elements, electric wirings, extraction electrode pads, nozzles, and ejection orifices 104 are formed on a substrate 101. An external wiring board 106 for applying an electric signal from the outside is provided on the ejection chip. The wiring of the external wiring board is electrically bonded to the electrode pad of the ejection chip via an electrode bump 105. This electrical bonding portion is sealed with a resin sealing material. The resin sealing portion 108 formed of this resin sealing material protects the bonding portion from ink.

The sealing using the resin sealing material can be performed by pouring the resin sealing material into a clearance between the ejection chip and the external wiring board and causing the resin sealing material to flow by a capillary force. The resin sealing material stops at the end surfaces of the ejection chip and the external wiring board due to surface tension to be formed into a shape illustrated in FIGS. 13, 14A, and 14B. In this case, on a face surface 103F side (ejection orifices 104 side) of the ejection chip, ridgelines 111 with a sharp tip extending from corners of the external wiring board are formed on the resin sealing material.

In order to maintain printing performance of the ink jet recording head, it is necessary to maintain cleanliness of the face surface. However, when wiping is performed using a wiper 112 in order to maintain the cleanliness of the face surface in a state where such ridgelines 111 are formed, the following problems occur.

When wiping is performed, as illustrated in FIGS. 15 and 16, the wiper 112 hits the ridgelines 111 of the resin sealing material extending from the corners of the external wiring board to cause cracks or peeling of the resin sealing material of the electrical bonding portion. After that, ink permeates the portion where the cracks or the peeling occurs to cause corrosion of the external wiring or the electrode pad, which causes the electrical failure. Further, when the wiper 112 hits the ridgelines 111 of the resin sealing material, fissures or chips of the wiper occur to cause deterioration of the function of the wiper, and the printing performance may become unstable. Note that such a problem at the time of wiping is not limited to a case where the wiper 112 and the ink jet recording head move relative to each other in a direction as illustrated in FIG. 15, that is, an arrangement direction of the ejection orifices 104. That is, for example, even in a case where the wiper 112 moves in a direction orthogonal to the arrangement direction of the ejection orifices, the ridgeline 111 and the wiper 112 may come into contact with each other, which may cause the above problem.

SUMMARY

Then, an object of the present disclosure is to solve the above-described problem. That is, an object of the present disclosure is to provide an ink jet recording head and an ink jet recording apparatus which suppress the occurrence of cracks or peeling of a resin sealing material during wiping using a wiper for maintaining printing performance to improve electrical reliability of a head. Another object of the present disclosure is to provide an ink jet recording head and an ink jet recording apparatus which prevent the occurrence of fissures or chips of the wiper to suppress deterioration of a function of the wiper, and maintain printing performance.

According to an aspect of the present disclosure, there is provided an ink jet recording head includes an ejection chip in which a plurality of ejection orifices performing ejection are arranged; an external wiring board including an external wiring for applying an electric signal to the ejection chip from an outside; an electrical bonding portion where the external wiring of the external wiring board and the ejection chip are electrically bonded to each other; and a resin sealing portion that seals the electrical bonding portion, in which a corner of the external wiring board where a first end surface on an ejection chip side and a side end surface connected to the first end surface intersect has a chamfered portion which is chamfered, and the chamfered portion is positioned within a width of the ejection chip in an ejection orifice arrangement direction.

According to another aspect of the present disclosure, there is provided an ink jet recording apparatus including the ink jet recording head described above and a wiper that wipes a face surface of the ejection chip in which the ejection orifices are formed.

Further features of the present disclosure will become apparent from the following description of exemplary embodiments with reference to the attached drawings.

BRIEF DESCRIPTION OF THE DRAWINGS

FIG. 3B1 is an enlarged view of a chamfered portion for describing the ink jet recording head of the embodiment of the present disclosure.

FIG. 3B2 is an enlarged view of the chamfered portion for describing the ink jet recording head of the embodiment of the present disclosure.

DESCRIPTION OF THE EMBODIMENTS

Hereinafter, embodiments of the present disclosure will be described with reference to the drawings.

Figure 1:
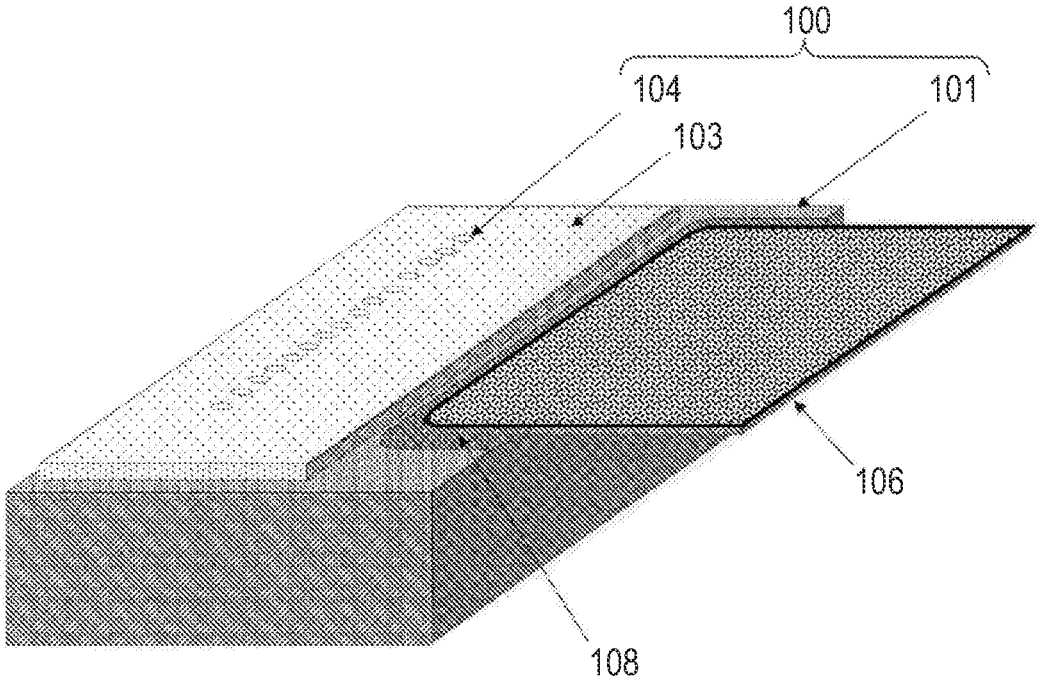
FIG. 1 is an explanatory diagram (perspective view) of an ink jet recording head of an embodiment of the present disclosure.
Figure 2A:
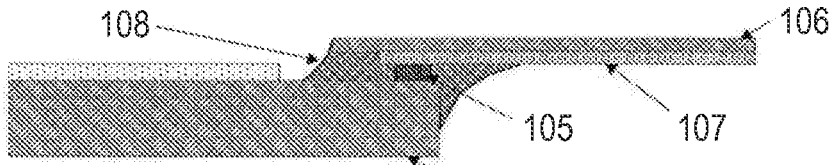
FIG. 2A is a sectional view for describing the ink jet recording head of the embodiment of the present disclosure, which is taken along line X-Y of FIG. 2B.
Figure 2B:
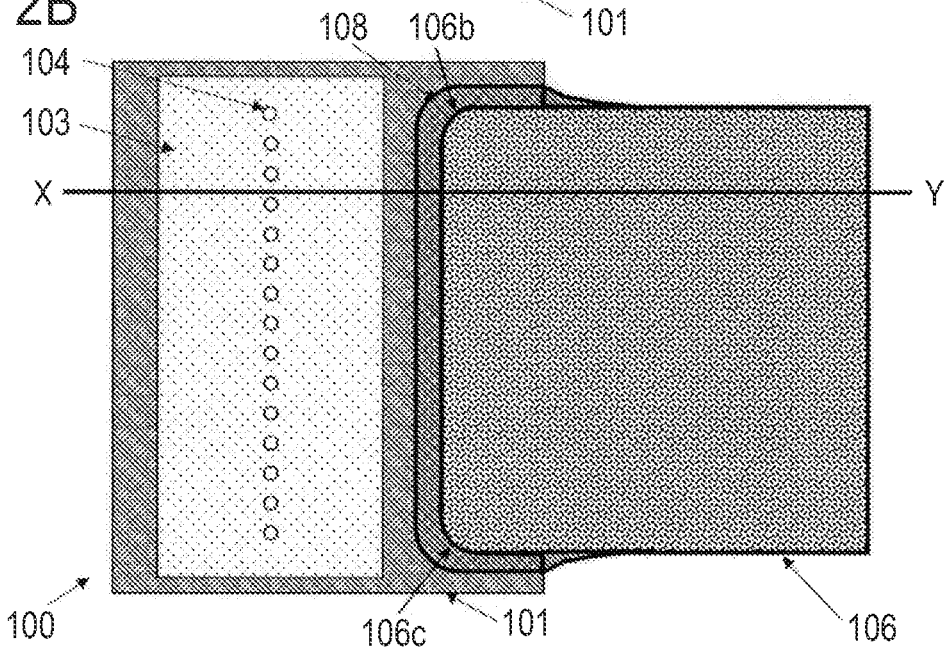
FIG. 2B is a plan view for describing the ink jet recording head of the embodiment of the present disclosure.
Figure 3A:
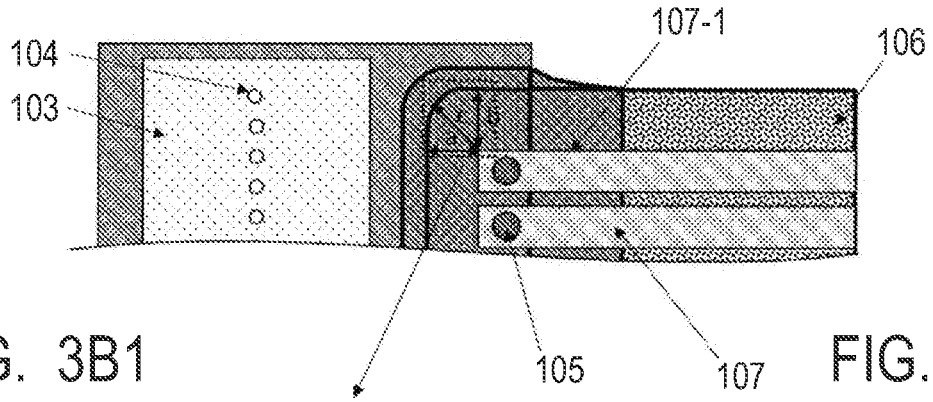
FIG. 3A is a perspective view for describing the ink jet recording head of the embodiment of the present disclosure, which is seen from a front surface side of an external wiring board.
Figure 3A:
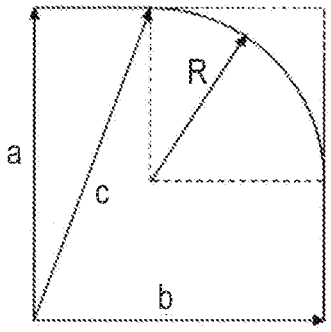
Figure 3A:
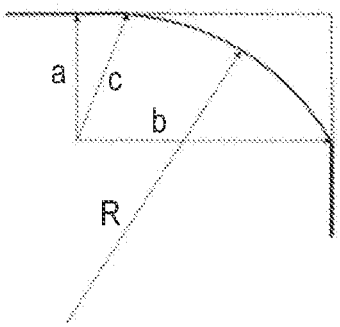
Figure 4:
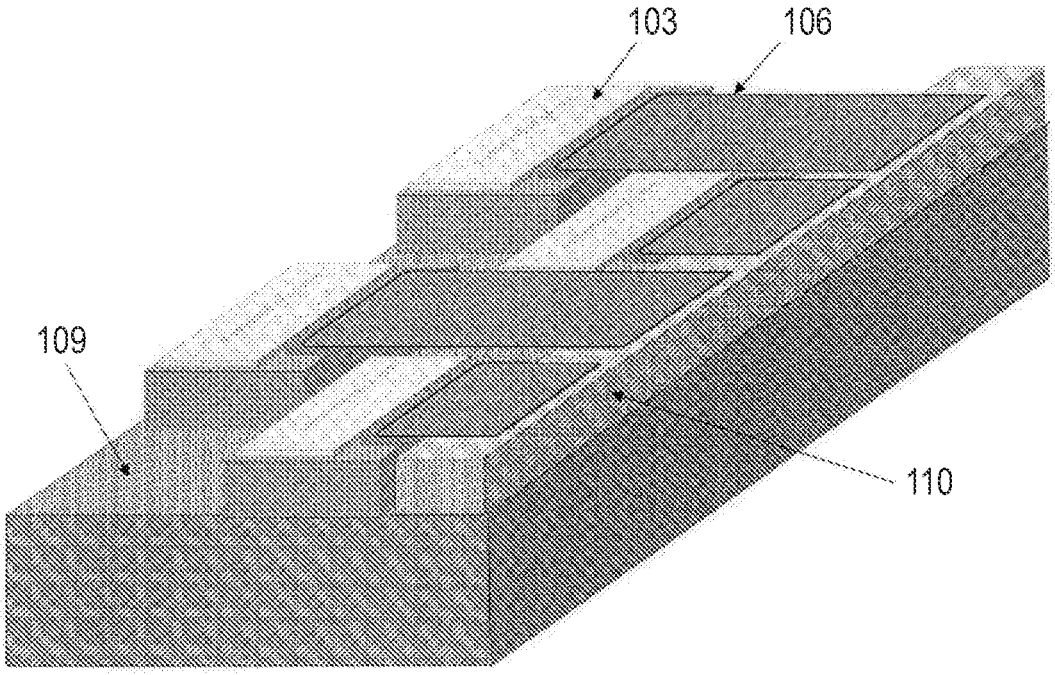
FIG. 4 is an explanatory diagram (perspective view) of the ink jet recording head of the embodiment of the present disclosure.
Figure 5:
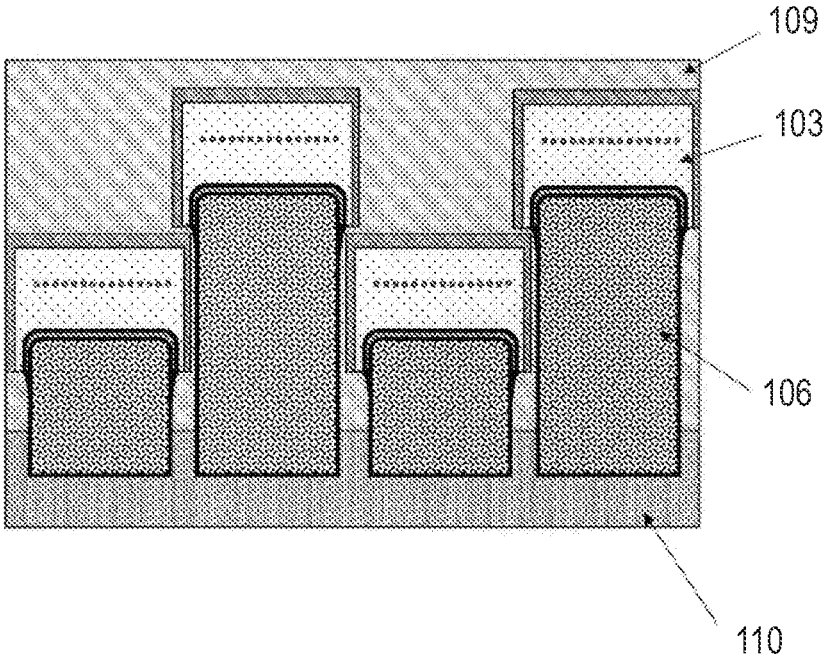
FIG. 5 is an explanatory diagram (plan view) of the ink jet recording head of the embodiment of the present disclosure.
Figure 6A:
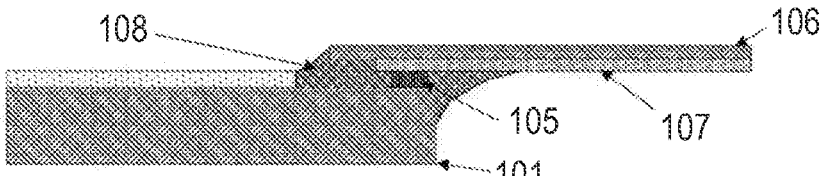
FIG. 6A is a sectional view for describing an ink jet recording head of another embodiment of the present disclosure, which is taken along line X-Y of FIG. 6B.
Figure 6B:
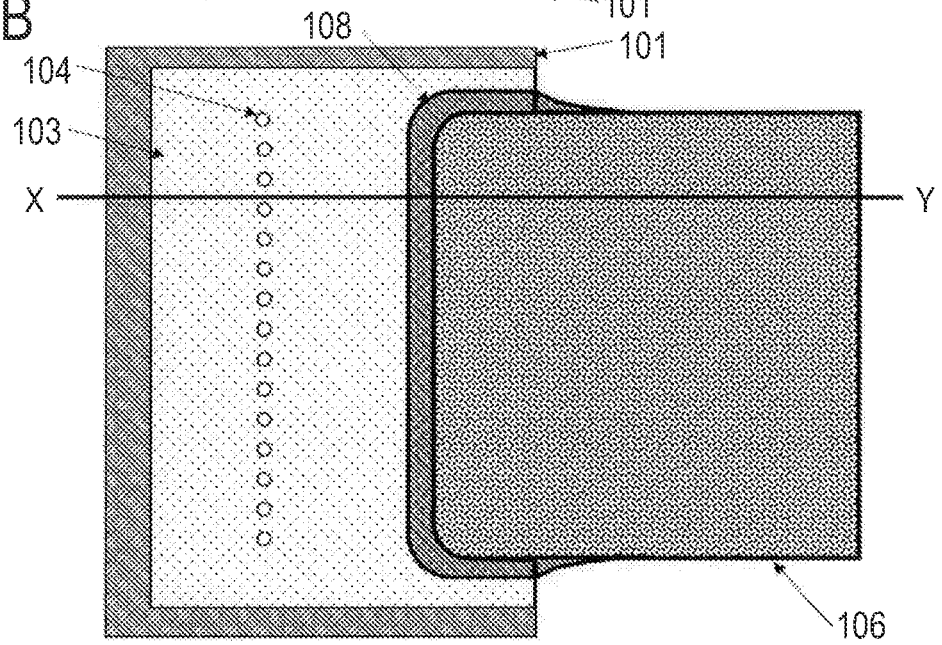
FIG. 6B is an explanatory diagram of the ink jet recording head of the other embodiment of the present disclosure.
Figure 17:
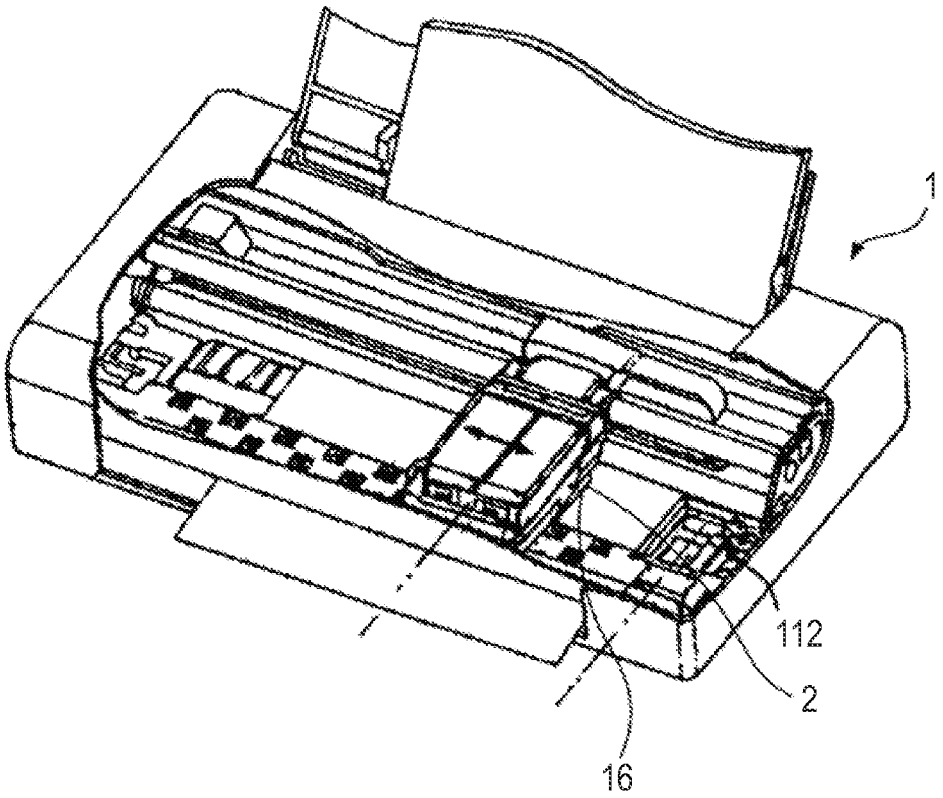
FIG. 17 is a perspective view illustrating an example of an ink jet recording apparatus.

FIGS. 1, 2A, 2B, 3A, 3B1, 3B2, 4 and 5 are explanatory diagrams of an ink jet recording head of an embodiment of the present disclosure, and FIGS. 6A and 6B are explanatory diagrams of another embodiment. FIG. 17 is a perspective view of an example of an ink jet recording apparatus 1 that can use an ink jet recording head 2 of the embodiment of the present disclosure. FIG. 1 is a perspective view corresponding to FIGS. 2A, 2B, 3A, 3B1, and 3B2. FIG. 2A is a sectional view taken along line X-Y of FIG. 2B, and FIG. 2B is a plan view. FIG. 3A is a perspective view (perspective view of an upper portion of FIG. 2B) which is viewed from a front surface side of an external wiring board, and FIGS. 3B1 and 3B2 are enlarged views of a chamfered portion.

The ink jet recording apparatus 1 of the embodiment of the present disclosure includes the ink jet recording head 2 and a wiper 112. This ink jet recording apparatus 1 performs cleaning by wiping a face surface using the wiper 112 and removing ink droplets or the like attached to the face surface in a case of a recovery process of an ejection surface 16 (face surface) in which ejection orifices, which eject ink, of the ink jet recording head 2 are formed.

The ink jet recording head of the embodiment of the present disclosure includes an ejection chip 100 for ejecting ink, and an external wiring board 106 for applying an electric signal to the ejection chip 100 from the outside.

As illustrated in FIGS. 1, 2A, 2B, 3A, 3B1 and 3B2, the ejection chip 100 includes a substrate 101, and pressure-generating elements provided to correspond to the ejection orifices, electric wirings for transmitting an electric signal to the pressure-generating elements, and extraction electrode pads electrically connected to the electric wirings (neither is illustrated) which are provided on the substrate. Further, the ejection chip 100 also includes a member (orifice portion) 103 in which nozzles (not illustrated) and ejection orifices 104 are formed. On such a substrate 101 of the ejection chip 100, a portion including at least one end portion of the external wiring board 106 is disposed and electrically connected.

As illustrated in FIGS. 2A, 2B, 3A, 3B1, and 3B2, an external wiring board in which wirings formed of an electroconductive material as external wirings 107 are formed on a base material can be used as the external wiring board 106. The external wiring 107 extends from a first end surface of the external wiring board 106, which is disposed on the ejection chip 100 side, toward a second end surface (not illustrated) different from the first end surface. The external wiring 107 can be, for example, a linear wiring. As illustrated in FIG. 3A, a plurality of external wirings 107 can be formed, and for example, a line and space pattern can be formed.

Figure 8:
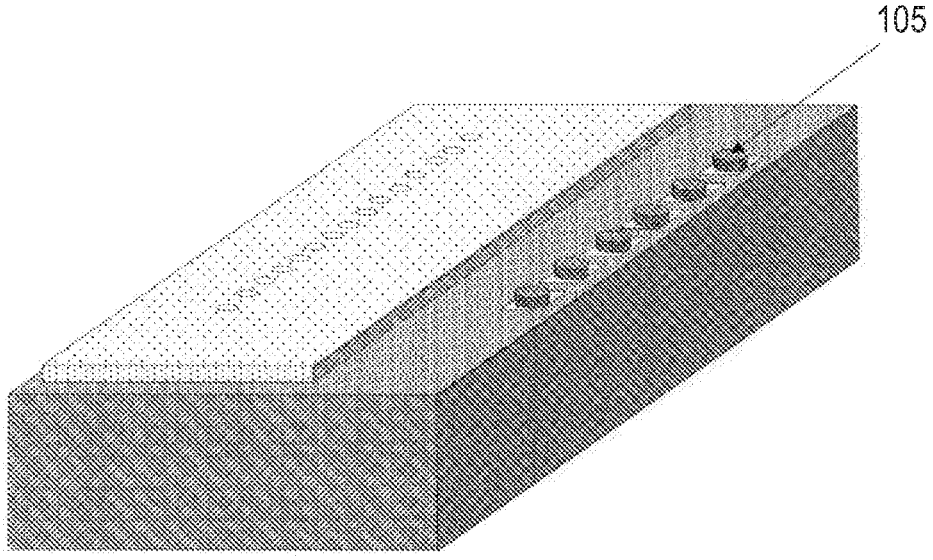
FIG. 8 is an explanatory diagram (perspective view) of the manufacturing process (process following FIG. 7) of the ink jet recording head of the embodiment of the present disclosure.
Figure 9:
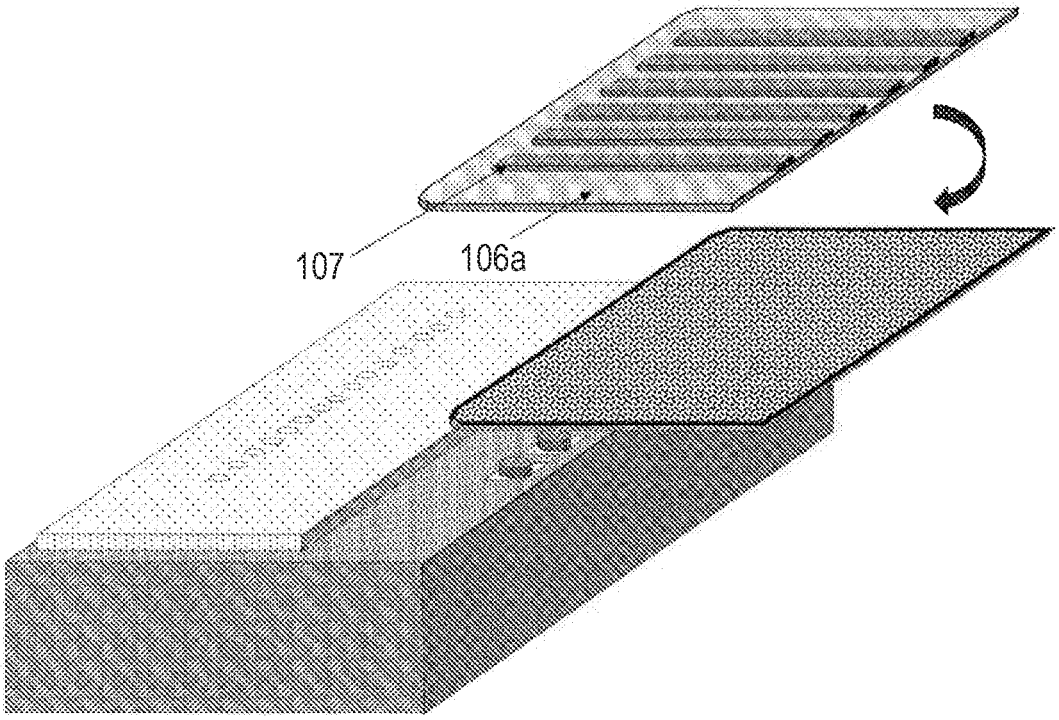
FIG. 9 is an explanatory diagram (perspective view) of the manufacturing process (process following FIG. 8) of the ink jet recording head of the embodiment of the present disclosure.

As illustrated in FIGS. 2A, 2B, 3A, 3B1, and 3B2, an extraction electrode pad (not illustrated) of the ejection chip 100 and the external wiring 107 of the external wiring board 106 are electrically bonded via an electrode bump 105 to form an electrical bonding portion. As indicated by reference numeral 102 in FIG. 7 described below, the extraction electrode pads can be arranged along an arrangement direction of the ejection orifices 104. As illustrated in FIG. 8 described below, the electrode bump 105 is provided on each electrode pad 102. As illustrated in FIG. 9 described below, the portion including an end portion of the external wiring board 106 overlaps the substrate of the ejection chip 100, so that the external wiring 107 of the external wiring board 106 is connected to the electrode bump 105. In this way, in the portion where the external wiring board 106 and the ejection chip 100 overlap each other, the external wiring 107 is electrically bonded to the extraction electrode pad 102 via the electrode bump 105 so that the electrical bonding portion is formed.

This electrical bonding portion is sealed with a resin sealing material to form a resin sealing portion 108. The resin sealing portion 108 protects the electrical bonding portion from ink or the like. The resin sealing portion can be formed by pouring the resin sealing material through a clearance between the ejection chip 100 and the external wiring board 106 by a capillary force. The resin sealing material stops at the end portion of the ejection chip 100 and the end portion of the external wiring board 106 due to surface tension to be formed into a shape illustrated in FIGS. 1, 2A, and 2B.

In order to form the above structure, the end portion of the external wiring board 106 is disposed within the width of the ejection chip 100 in the arrangement direction of the ejection orifices 104. That is, the width of the external wiring board 106 in a direction parallel to the ejection orifice arrangement direction of the ejection chip 100 (the up-down direction in FIG. 2B) is narrower than the width of the ejection chip 100 in the same direction, The width of the external wiring board 106 in the ejection orifice arrangement direction is preferably narrower than the width of the orifice portion 103 in the same direction. Since the width of the external wiring board 106 in the ejection orifice arrangement direction is sufficiently narrower than the width of the ejection chip in the ejection orifice arrangement direction, the resin sealing portion 108 can be formed on the substrate of the ejection chip 100 with a sufficient size along an outer edge of the external wiring board 106.

Further, as illustrated in FIGS. 2B and 3A, the external wiring board 106 has a substantially rectangular shape in its planar shape, and has chamfered portions obtained by the two corners on the ejection chip 100 side being chamfered. Since the width of the external wiring board 106 is narrower than the width of the ejection chip 100 as described above, the two chamfered portions are positioned within the width of the ejection chip 100 in the ejection orifice arrangement direction.

In this shape, in particular, as illustrated in FIG. 3A, the distance from an end portion of an outermost external wiring 107-1 of the external wiring board 106 (the end of the outer line of the external wiring) to an ejection orifice row side-end surface is set to a. Further, the distance from the end portion of the external wiring 107-1 to an end surface of the external wiring board in the width direction is set to b. Furthermore, the shortest distance among the distances from the end portion of the external wiring 107-1 to an end surface of the chamfered portion is set to c.

The outer shape of the external wiring board 106 (base material 106*a* (FIG. 9)) has chamfered portions in which two corners (106*b* and 106*c* (FIG. 2B)) where the side end portions and the first end surface on the ejection chip 100 side after electrical mounting intersect are chamfered. Specifically, it is preferable to have a shape to be described below with reference to FIGS. 3B1 and 3B2. The resistance of an electrical mounting portion to electrical corrosion due to ink permeation is determined by the distance between the wiring of the external wiring board 106 and the resin sealing material which is applied and cured after electrical mounting at the outer end portion of the external wiring board. Therefore, it is preferable that the distance a, and the distance b, are at least equal to or longer than 0.1 mm.

Further, in order to ensure the resistance of the electrical mounting portion to the electrical corrosion due to ink permeation, it is preferable that the shortest distance c is equal to or longer than the shorter one of either the distance a or the distance b. FIG. 3B1 illustrates an example of a case where the shortest distance c is longer than both the distance a and the distance b, and FIG. 3B2 illustrates an example of a case where the shortest distance c is longer than the distance a and is shorter than the distance b. The distance a and the distance b may be the same or different, but it is preferable that the difference between the distance a and the distance b is small, and it is more preferable that the distance a and the distance b are substantially the same. That is, it is preferable that a chamfering start point is a point displaced toward the intersection of both end surfaces from the points with the distance a and the distance b. From the viewpoint of avoiding sharpening of the corners, the chamfered R shape is preferably equal to or longer than ¼ of the shorter one of the distance a and the distance b, and more preferably equal to or longer than ⅓.

Further, in the configuration using such an external wiring board 106, it is preferable that on the face surface side of the ejection chip 100 in which the ejection orifices 104 are formed, the front surface of the resin sealing portion 108 along the outer edge of the external wiring board 106 has no ridgeline. By forming no ridgeline with a sharp tip on the resin sealing portion 108, it is possible to prevent the occurrence of cracks or peeling of the resin sealing portion 108 due to the wiper. In addition, it is possible to suppress the occurrence of fissures or chips of the wiper. In particular, in the configuration in which the electrical bonding portion of the ejection chip 100 and the external wiring board 106 is formed between the front surface of the substrate 101 and a back surface of the external wiring board 106 as in this embodiment, it is effective that the corners of the external wiring board 106 are chamfered. Here, in a case where a surface on the same side as the face surface of the ejection chip 100 where the ejection orifices 104 are formed is set as a front surface of the external wiring board 106, the back surface of the external wiring board 106 refers to a surface opposite to the front surface. In the configuration of the electrical bonding portion as in this embodiment, the resin sealing portion 108 covering the electrical bonding portion is disposed on the front surface of the substrate 101 along the outer edge of a part of the external wiring board 106 overlapping the substrate 101 of the ejection chip 100. That is, with the above-described configuration of the electrical bonding portion, since the outer shape of the resin sealing portion 108 can be easily determined due to the outer shape of the external wiring board 106, it is preferable that the corners of the external wiring board 106 have chamfered portions as in this embodiment.

(Other Embodiments)

Furthermore, an ink jet recording head of another embodiment of the present disclosure will be described with reference to FIGS. 6A and 6B.

As illustrated in FIG. 6B, in the ink jet recording head of this embodiment, the orifice portion 103 of the ejection chip 100 has, on a side facing the end portion of the external wiring board 106, a portion patterned into a shape similar to the planar shape of the external wiring board 106. That is, the orifice portion 103 has a shape having a predetermined interval (gap) along a peripheral surface of the external wiring board 106 on the ejection chip 100 side. The external wiring board 106 is disposed so as to be engaged with the patterned portion of the orifice portion 103, and the gap is filled with a resin sealing material to form the resin sealing portion 108. That is, on the substrate 101 of the ejection chip, the resin sealing portion 108 is formed in the entire area of the clearance between the orifice portion 103 and the external wiring board 106. Since the resin sealing portion 108 can be formed uniformly over the entire area of the clearance, the resin sealing can be stably performed, and the favorable resin sealing portion 108 can be formed.

(Production Method)

Hereinafter, an example of a manufacturing method of the ink jet recording head of the present disclosure will be described.

Figure 7:
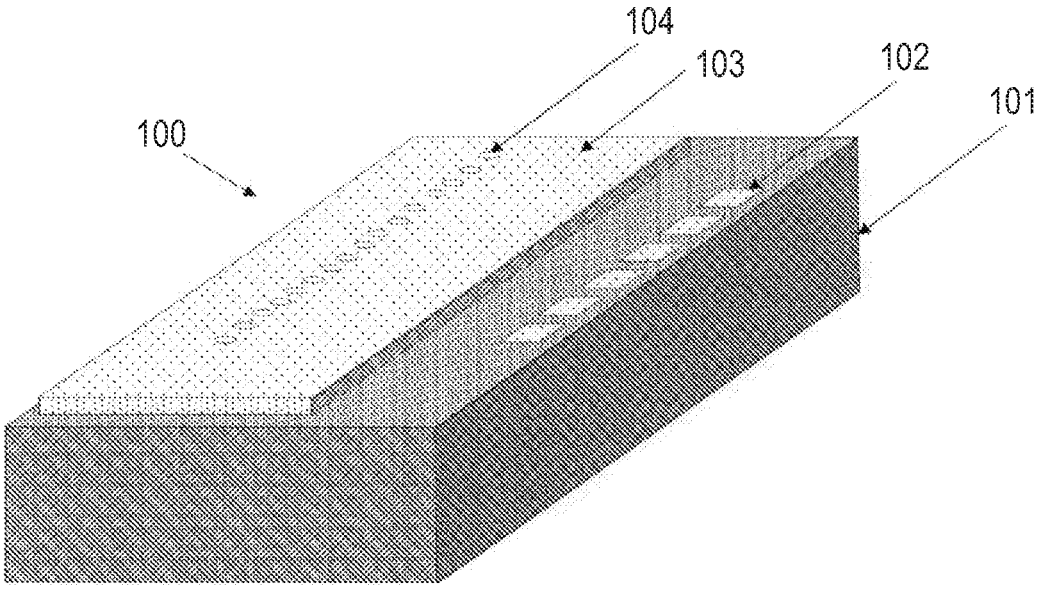
FIG. 7 is an explanatory diagram (perspective view) of a manufacturing process of an ink jet recording head of an embodiment of the present disclosure.

First, the ejection chip 100 illustrated in FIG. 7 is manufactured as follows. On the silicon substrate 101, a pressure-generating element, an electric wiring for supplying electricity to drive the pressure-generating element, and an electrode pad 102 for leading out the electricity to the outside are formed. Next, an ink supply port for supplying ink to the pressure-generating element is formed on the silicon substrate 101. Subsequently, the orifice portion including nozzles and the ejection orifices 104 for ejecting ink are formed. The electrode pad row of the ejection chip is disposed in the same direction as the ejection orifice row, in an area shorter than the width of the ejection chip in the ejection orifice row.

Next, as illustrated in FIG. 8, the electrode bumps 105 are formed on the electrode pads 102 by plating or wire bonding.

On the other hand, as illustrated in FIG. 9, an external wiring board in which the external wiring 107 is formed on the base material 106*a* can be used as the external wiring board 106 for applying electricity to the ejection chip. As the base material 106*a* of the external wiring board 106, a flexible film made of a heat resistant resin such as Kapton (registered trademark) or Upilex (registered trademark) can be used. The base material 106*a* of the external wiring board 106 may be a rigid material such as glass epoxy. The external wiring 107 made of a metal such as copper can be formed on such a base material 106*a*. A bonding metal such as gold plating can be formed on the electrical bonding portion with the electrode bump 105.

Figure 10A:
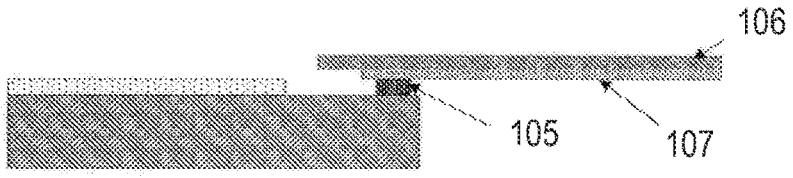
FIG. 10A is a sectional view for describing the manufacturing process (process following FIG. 9) of the ink jet recording head of the embodiment of the present disclosure, which is taken along line X-Y of FIG. 10B.
Figure 10B:
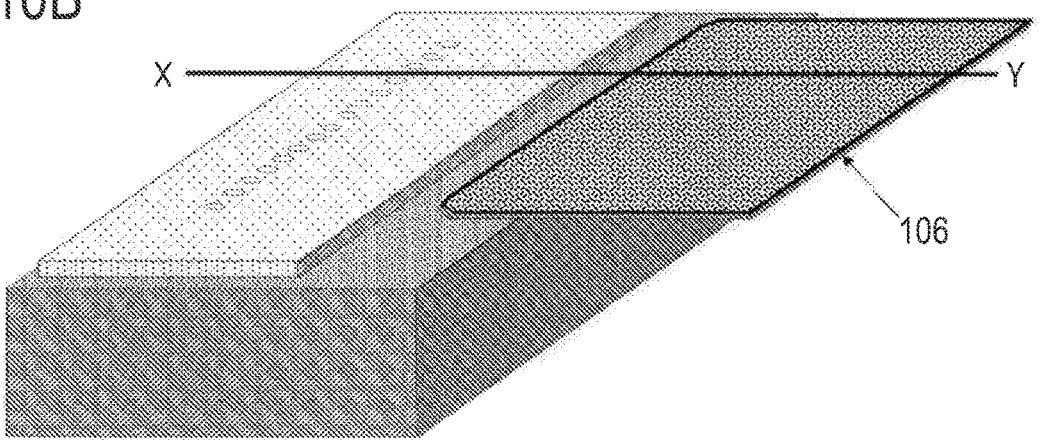
FIG. 10B is an explanatory diagram of the manufacturing process (process following FIG. 9) of the ink jet recording head of the embodiment of the present disclosure.

Next, as illustrated in FIGS. 10A and 10B the electrode bumps 105 on the ejection chip and the external wiring 107 of the external wiring board 106 are metal-bonded by ultrasonic waves or thermocompression.

Figure 11A:
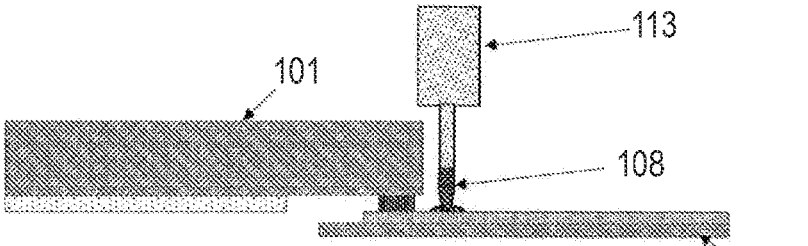
FIG. 11A is a sectional view for describing the manufacturing process (process following FIGS. 10A and 10B) of the ink jet recording head of the embodiment of the present disclosure, which is taken along line X-Y of FIG. 11B.
Figure 11B:
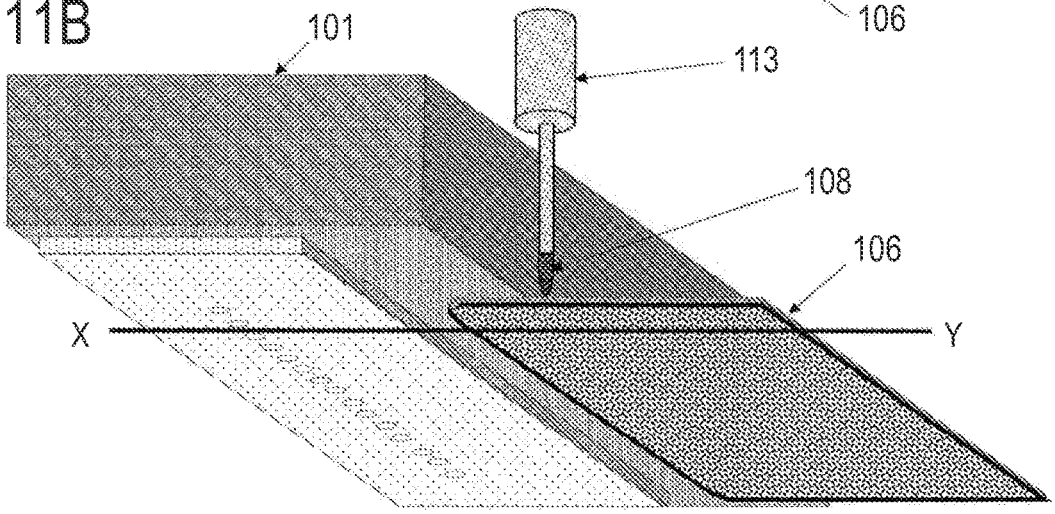
FIG. 11B is an explanatory diagram of the manufacturing process (process following FIGS. 10A and 10B) of the ink jet recording head of the embodiment of the present disclosure.
Figure 12A:
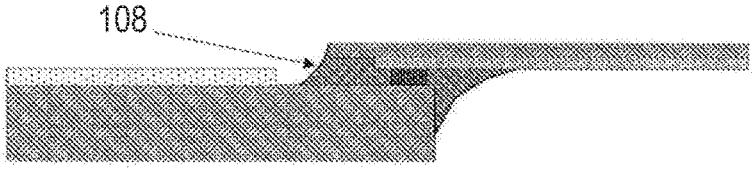
FIG. 12A is a sectional view for describing the manufacturing process (process following FIGS. 11A and 11B) of the ink jet recording head of the embodiment of the present disclosure, which is taken along line X-Y of FIG. 12B.
Figure 12B:
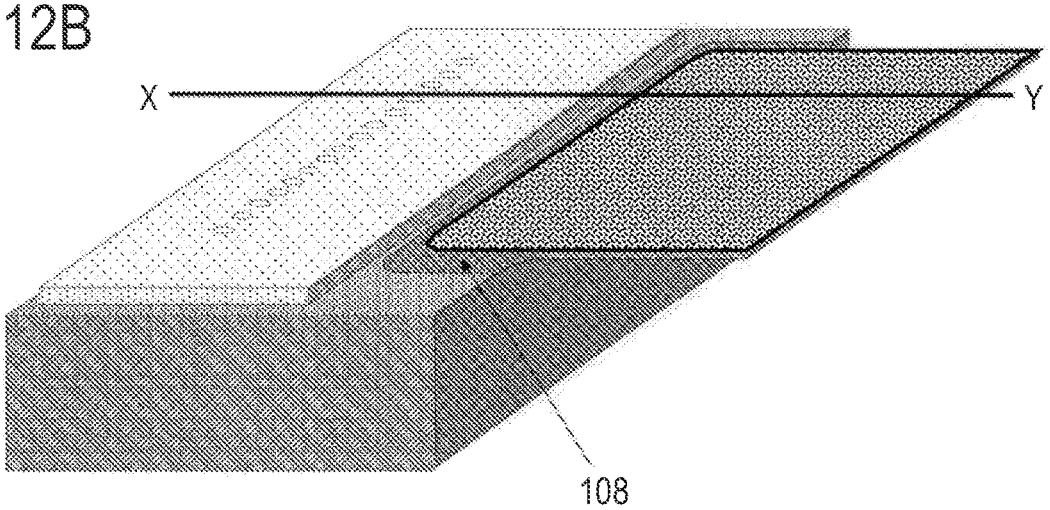
FIG. 12B is an explanatory diagram of the manufacturing process (process following FIGS. 11A and 11B) of the ink jet recording head of the embodiment of the present disclosure.
Figure 13:
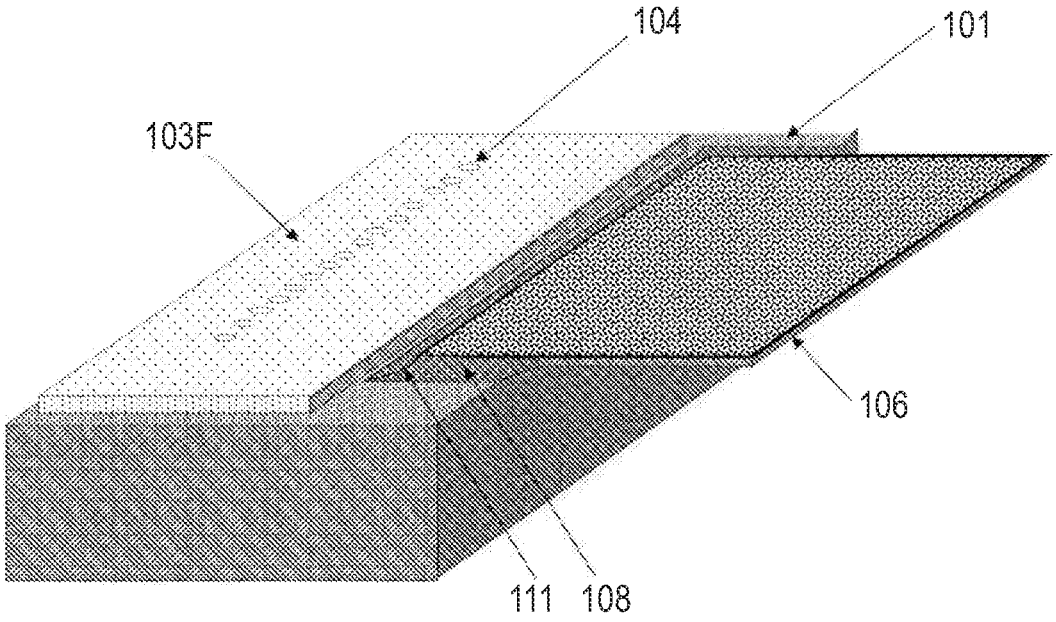
FIG. 13 is an explanatory diagram (perspective view) of an ink jet recording head in the related art.
Figure 14A:
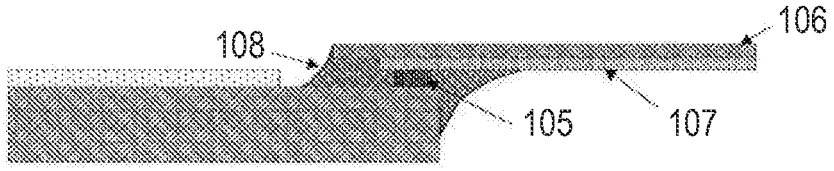
FIG. 14A is a sectional view for describing the ink jet recording head in the related art, which is taken along line X-Y of FIG. 14B.
Figure 14B:
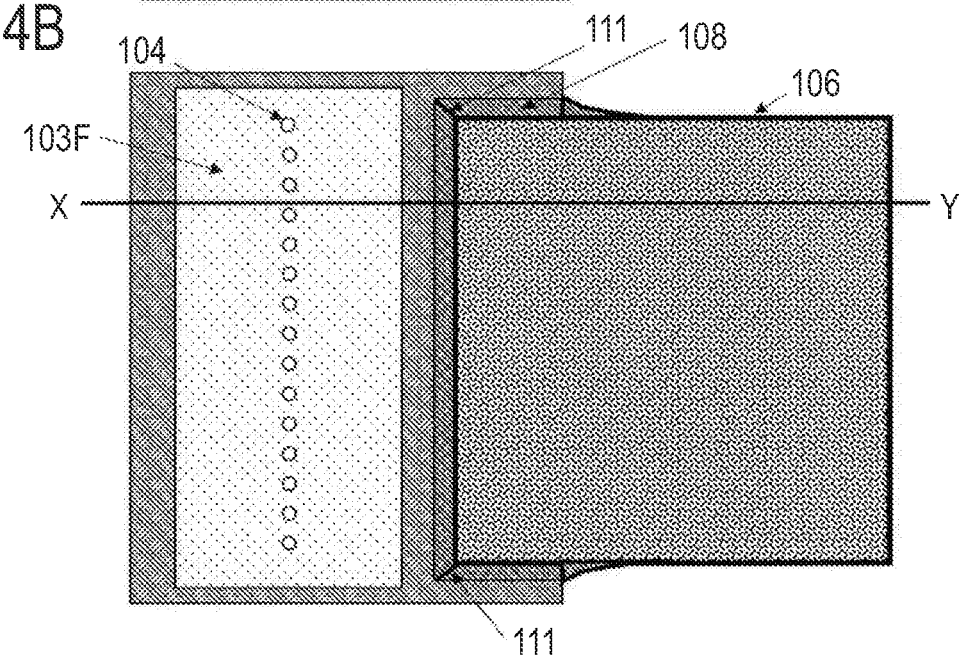
FIG. 14B is an explanatory diagram of the ink jet recording head in the related art.
Figure 15:
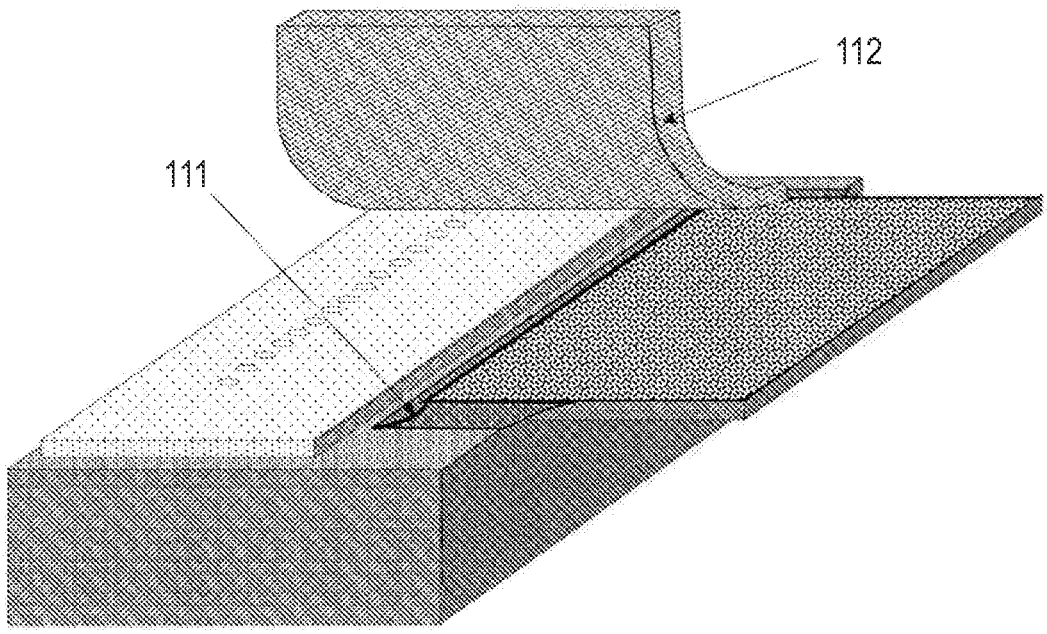
FIG. 15 is an explanatory diagram (perspective view) of a problem of the ink jet recording head in the related art.
Figure 16:
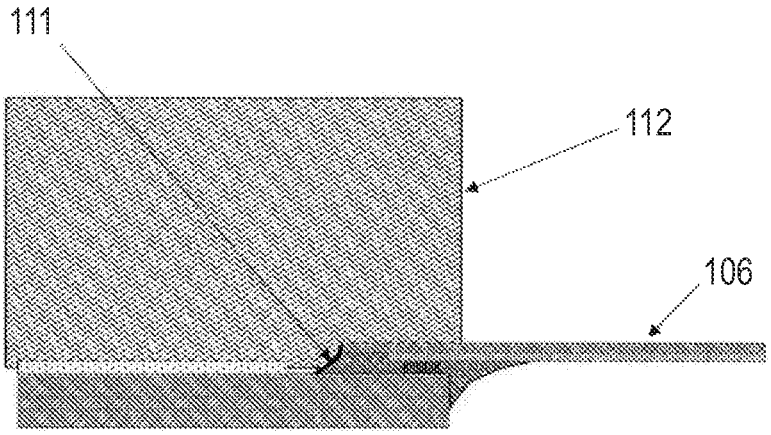
FIG. 16 is an explanatory diagram (sectional view) of the problem of the ink jet recording head in the related art.

After that, as illustrated in FIGS. 11A and 11B, the resin sealing material is ejected onto the back surface in the vicinity of the electrical bonding portion (the surface on the side of the electrical bonding portion) of the external wiring board 106 using a dispenser 113. The resin sealing material flows into the clearance between the ejection chip 100 and the external wiring board 106, flows due to surface tension, and stops at the end portion of the ejection chip and the end portion of the external wiring board. As a result, as illustrated in FIGS. 12A and 12B, the electrical bonding portion between the electrode pad 102 of the ejection chip 100 and the external wiring 107 of the external wiring board 106 via the electrode bump 105 is sealed.

The external wiring board 106 (base material 106*a*) has an outer shape in which two corners on the ejection chip side after electrical mounting are chamfered. Therefore, a ridgeline with a sharp tip is not formed on the front surface of the resin sealing portion due to the corners of the external wiring board. As a result, the front surface of the resin sealing portion 108 formed on the substrate 101 along the outer edge of the external wiring board 106 is smooth. As described above, it is possible to obtain an ejection module (ink jet recording head) in which the external wiring board 106 is electrically mounted on the ejection chip 100 as illustrated in FIGS. 1, 2A, and 2B.

Next, as illustrated in FIGS. 4 and 5, a plurality of ejection modules are mount-bonded to a flow path plate 109 for supplying ink. Next, an external wiring board is electrically bonded to the circuit substrate 110 to complete the ink jet recording head. Although FIG. 5 corresponds to the plan view of FIG. 4, the structure of the ejection chip of FIG. 4 corresponds to FIGS. 1, 2A, and 2B, and the structure of the ejection chip of FIG. 5 corresponds to FIGS. 6A and 6B.

In the ink jet recording head including the ejection module in which the external wiring board is electrically mounted on the ejection chip, which is manufactured as described above, a ridgeline with a sharp tip is not formed on the front surface of the resin sealing portion. Therefore, it is possible to prevent cracks or peeling of the resin scaling portion due to the wiper. In addition, it is possible to suppress the occurrence of fissures or chips of the wiper.

In the above-described embodiment, both the two corners 106*b* and 106*c* of the external wiring board 106 have a chamfered portion, but the present disclosure is not limited to this, and at least one of the corners 106*b* and 106*c* may have a chamfered portion. As a result, it is possible to suppress the occurrence of the above problems during wiping. Further, it is preferable that one of the two corners positioned upstream in the wiping direction has a chamfered portion, and it is more preferable that both the two corners have a chamfered portion.

Further, in the above-described embodiment, a configuration is adopted in which the external wiring board 106 provided with the external wiring for applying an electric signal to the ejection chip from the outside is electrically mounted on one surface side of the ejection chip 100 in which a plurality of ejection orifices for performing ejection are arranged, but the present disclosure is not limited to this. That is, the same effect can be obtained in a case where electrical mounting is performed not only on one surface but also on both surfaces of the ejection chip 100.

EXAMPLE

Hereinafter, examples of the present disclosure will be described with reference to the drawings.

Example 1-1

First, an ejection chip illustrated in FIG. 7 was manufactured as follows. A heating resistor as a pressure-generating element was formed on the silicon substrate 101 by performing film formation and etching. Next, an electric wiring that distributes electricity for driving the heating resistor to heat ink was formed by performing film formation and etching. Subsequently, a protective film for protection from ink was formed thereon. After that, the electrode pads 102 for connection to an external wiring board were formed by patterning the protective film. Sixteen heating resistors were arranged at 150 dpi, and the length of the arrangement was 2.7 mm. The electrode pads with a protective film opening size of 0.1 mm×0.1 mm are arranged at a pitch of 0.185 mm, and the length of the arrangement is 1.11 mm.

Next, an ink supply port was formed on the silicon substrate by performing dry etching. Next, nozzles were formed by laminating a photosensitive resin thereon and performing photolithography, and subsequently, ejection orifices 104 were formed by laminating a photosensitive resin and performing photolithography. The ejection orifices 104 were formed to correspond to the heating resistors, 16 ejection orifices were arranged at 150 dpi, and the length of the arrangement was 2.7 mm. The chip width of the ejection chip in the ejection orifice arrangement direction was 3 mm. As described above, the ejection chip illustrated in FIG. 7 was obtained.

On the other hand, as illustrated in FIG. 9, an external wiring 107 was formed by laminating copper foil (35 μm thickness) on a film 106*a* (50 μm thickness) made of Upilex (registered trademark) and performing etching. Then, nickel and gold were plated thereon to form gold on the uppermost layer of the external wiring pattern.

Then, punching was performed using a mold to obtain an external wiring board having the following size and shape (FIGS. 2B and 3A).

The external dimension of the external wiring board is a width of 2 mm, which is narrower than the width of the ejection chip.

The first end surface on the ejection chip side and the side end surfaces of the external wiring board are connected by an arc of R0.2 mm Six external wirings with a width of 0.12 mm (length in the up-down direction of FIG. 3A) were arranged at a pitch of 0.185 mm, and the length of the arrangement was 1.11 mm.

A distance A from an outer corner of an ejection orifice row side-end portion of an outermost external wiring 107-1 on the film to an ejection orifice row side-end surface of the external wiring board 106 was 0.4 mm, and a distance B from the outer corner of the ejection orifice row side-end portion of the outermost external wiring 107-1 on the film to an end surface in the external wiring width direction was 0.4 mm. The shortest distance (c) from the outer corner of the same external wiring 107-1 to an end surface of a chamfered portion (arc) of the external wiring board was 0.45 mm (FIG. 3B1).

Since the distance (c) is longer than the distance A and the distance B and the distance from the wiring to the resin sealing end portion of the electrical mounting is secured, reliability could be secured.

Next, as illustrated in FIG. 8, gold electrode bumps 105 were formed on the electrode pads of the ejection chip by gold wire bonding to obtain ejection chip with bumps.

Next, as illustrated in FIGS. 10A and 10B, the gold electrode bumps 105 on the ejection chip and the external wirings 107 on the external wiring board were metal-bonded by ultrasonic waves and heat.

Thereafter, as illustrated in FIGS. 11A and 11B, an underfill material for semiconductor electrical mounting (manufactured by Panasonic Corporation, product name: CV5350AS) as a resin sealing material was ejected onto the back surface in the vicinity of the electrical bonding portion of the external wiring board using a dispenser 113. The resin sealing material flowed into the clearance between the ejection chip and the external wiring board, flowed due to surface tension, and stopped at the end portion of the ejection chip and the end portion of the external wiring board. As a result, as illustrated in FIGS. 12A and 12B, the electrical bonding portion between the electrode pad of the ejection chip and the external wiring of the external wiring board via the electrode bump was sealed.

The external wiring board 106 (base material 106*a*) has an outer shape in which an ejection orifice row side-end portion after electrical mounting and end portions in the external wiring width direction are connected by an arc. Therefore, a sharp ridgeline was not formed on the front surface of the resin sealing portion due to the corner of the end portion of the external wiring board, and the front surface of the resin sealing portion had a smoothly changing shape. As described above, the ejection module in which the external wiring board was electrically mounted on the ejection chip, illustrated in FIGS. 1, 2A, and 2B, was obtained.

Next, as illustrated in FIG. 4, four ejection modules were mount-bonded to a flow path plate 109 for supplying ink. Next, an external wiring board was electrically bonded to the circuit substrate 110 to complete an ink jet recording head in which the length of the arrangement of ejection orifices was 10.8 mm.

The completed ink jet recording head was placed on a printer and a printing durability test was conducted.

It was found that there was no crack or peeling of the electrical mounting sealing portion on the face surface side of the ejection chip of the ink jet recording head, and the reliability of the electrical mounting sealing portion was improved.

Further, there was no chip or fissure of the wiper for wiping the face surface, the wiper having no chip or fissure made the face surface in a good state, and there was no deterioration in printing.

Example 1-2

In Example 1-2, an ink jet recording head was manufactured in the same manner as in Example 1-1, except that the dimension of the external wiring board 106 was different as follows.

The external dimension of the external wiring board 106 was a width of 2.8 mm, which was narrower than the width of the ejection chip 100.

The first end surface on the ejection chip 100 side and the side end surfaces of the external wiring board 106 were connected by an arc of R1.6 mm Six external wirings with a width of 0.12 mm were arranged at a pitch of 0.185 mm, and the length of the arrangement was 1.11 mm A distance A from an outer corner of an ejection orifice row side-end portion of an outermost external wiring 107-1 on the film to an ejection orifice row side-end surface of the external wiring board 106 was 0.4 mm, and a distance B from the outer corner of the ejection orifice row side-end portion of the outermost external wiring 107-1 on the film to an end surface in the external wiring width direction was 0.8 mm The shortest distance (c) from the outer corner of the same external wiring 107-1 to an end surface of a chamfered portion (arc) of the external wiring board 106 was 0.43 mm (FIG. 3B2).

Since the distance (c) is longer than the distance A, which is shorter one of the distance A and the distance B, and the distance from the wiring to the resin sealing end portion of the electrical mounting is secured, reliability could be secured.

Example 2

FIGS. 6A and 6B illustrate an ejection module (ejection chip electrically bonded to an external wiring board) of an ink jet recording head manufactured in Example 2.

As illustrated in FIG. 6B, the orifice portion 103 of the ejection chip 100 has, on a side facing the end portion of the external wiring board 106, a shape patterned into a shape similar to the planar shape of the external wiring board 106. The resin sealing portion 108 is formed between outer edges of the facing similar shapes of the orifice portion 103 and the external wiring board 106. That is, on the substrate 101 of the ejection chip 100, the resin sealing portion 108 is formed in the entire area of the facing clearance between the orifice portion 103 and the external wiring board 106.

The ink jet recording head of Example 2 was manufactured by the same process as in Example 1 except that the outer shape was changed to the shape illustrated in FIG. 6B in the process of forming the orifice portion 103. In the process of forming the orifice portion, the external wiring board side of the pattern of the photosensitive resin forming the nozzles and the ejection orifices was processed into the same shape as the planar outer shape of the external wiring board 106 on the electrical bonding portion side.

In this example, the orifice portion 103 in which the facing side was formed into the same shape was provided at a distance from the outer edge of the external wiring board 106 on the electrical bonding portion side. Therefore, it was possible for the area of the resin sealing portion of the electrical bonding portion not to protrude from the clearance where the external wiring board and the orifice portion face each other. As a result, the resin sealing of the electrical bonding portion was stably performed.

Then, as in Example 1, there was no occurrence of sharp corners such as ridgelines on the front surface of the resin sealing portion of the electrical bonding portion, and the surface was smooth. As a result of a printing durability test performed on the ink jet recording apparatus provided with the obtained ejection module, the same effect as in Example 1 was obtained.

While the present disclosure has been described with reference to exemplary embodiments, it is to be understood that the disclosure is not limited to the disclosed exemplary embodiments, The scope of the following claims is to be accorded the broadest interpretation so as to encompass all such modifications and equivalent structures and functions.

This application claims the benefit of Japanese Patent Application No. 2019-147529, filed Aug. 9, 2019, which is hereby incorporated by reference herein in its entirety.

What is claimed is:

1. An ink jet recording head comprising:

an ejection chip in which a plurality of ejection orifices performing ejection are arranged;

an external wiring board including an external wiring for applying an electric signal to the ejection chip from an outside;

an electrical bonding portion where the external wiring of the external wiring board and the ejection chip are electrically bonded to each other; and a resin sealing portion that seals the electrical bonding portion, wherein a corner of the external wiring board where a first end surface on an ejection chip side and a side end surface connected to the first end surface intersect has a chamfered portion which is chamfered, the chamfered portion is positioned within a width of the ejection chip in an ejection orifice arrangement direction, the chamfered portion is arranged in a vicinity of the electrical bonding portion, and the resin sealing portion is arranged around the chamfered portion.

2. The ink jet recording head according to claim 1, wherein two corners of the external wiring board where the first end surface and side end surfaces, each of which is connected to the first end surface, intersect have the chamfered portions, and the two chamfered portions are positioned within the width of the ejection chip in the ejection orifice arrangement direction.

3. The ink jet recording head according to claim 1, wherein the ejection chip has a member in which the ejection orifices are formed, and a substrate, the substrate includes an electrode pad on a front surface side where the member is disposed, the electrode pad is electrically connected to the external wiring, an area including the electrode pad on the front surface of the substrate and a part of the external wiring board are disposed to overlap each other such that the electrical bonding portion is formed between the front surface of the substrate and the external wiring board, and the resin sealing portion is disposed on the front surface of the substrate along an outer edge of the part of the external wiring board.

4. The ink jet recording head according to claim 1, wherein on a face surface side of the ejection chip where the ejection orifices are formed, there is no ridgeline on a front surface of the resin sealing portion along an outer edge of the external wiring board.

5. The ink jet recording head according to claim 1, wherein in a planar shape of the external wiring board, a distance c from an end portion of the outermost external wiring of the external wiring board to an end surface of the chamfered portion of the external wiring board is equal to or longer than a shorter distance of either a distance a from the end portion of the external wiring to the first end surface connected to the chamfered portion, or a distance b from the end portion of the external wiring to the side end surface of the external wiring board.

6. The ink jet recording head according to claim 1, wherein a member of the ejection chip in which the ejection orifices are formed has, on a side facing the end portion of the external wiring board, a portion patterned into a shape similar to a planar shape of the external wiring board, and the external wiring board is disposed to be engaged with the patterned portion.

7. The ink jet recording head according to claim 6, wherein a predetermined gap is provided between the patterned portion of the member of the ejection chip in which the ejection orifices are formed and the external wiring board, and the gap is filled with a resin sealing material to form the resin sealing portion.

8. The ink jet recording head according to claim 1,
wherein the ejection chip includes, on a substrate,
pressure-generating elements provided to correspond to the ejection orifices,
a wiring that transmits an electric signal to the pressure-generating elements, and
an extraction electrode pad electrically connected to the wiring, and
the external wiring of the external wiring board is electrically bonded to the extraction electrode pad of the ejection chip via an electrode bump.

9. The ink jet recording head according to claim 1,
wherein the chamfered portion is positioned within the width of the ejection orifice arrangement direction of the ejection chip, the ejection ship being adjacent to and being opposite to the first end surface.

10. An ink jet recording apparatus comprising:
an ink jet recording head including an ejection chip in which a plurality of ejection orifices performing ejection are arranged, an external wiring board including an external wiring for applying an electric signal to the ejection chip from an outside, an electrical bonding portion where the external wiring of the external wiring board and the ejection chip are electrically bonded to each other, and a resin sealing portion that seals the electrical bonding portion; and
a wiper that wipes a face surface of the ejection chip in which the ejection orifices are formed,
wherein a corner of the external wiring board where a first end surface on an ejection chip side and a side end surface connected to the first end surface intersect has a chamfered portion which is chamfered,
the chamfered portion is positioned within a width of the ejection chip in an ejection orifice arrangement direction,
the chamfered portion is arrange in a vicinity of the electrical bonding portion, and
the resin sealing portion is arranged around the chamfered portion.

11. The ink jet recording apparatus according to claim 10,
wherein two corners of the external wiring board where the first end surface and side end surfaces, each of which is connected to the first end surface, intersect have the chamfered portions, and
the two chamfered portions are positioned within the width of the ejection chip in the ejection orifice arrangement direction.

12. The ink jet recording apparatus according to claim 10,
wherein the ejection chip has a member in which the ejection orifices are formed, and a substrate,
the substrate includes an electrode pad on a front surface side where the member is disposed,
the electrode pad is electrically connected to the external wiring,
an area including the electrode pad on the front surface of the substrate and a part of the external wiring board are disposed to overlap each other such that the electrical bonding portion is formed between the front surface of the substrate and the external wiring board, and
the resin sealing portion is disposed on the front surface of the substrate along an outer edge of the part of the external wiring board.

13. The ink jet recording apparatus according to claim 10,
wherein on a face surface side of the ejection chip where the ejection orifices are formed, there is no ridgeline on a front surface of the resin sealing portion along an outer edge of the external wiring board.

14. The ink jet recording apparatus according to claim 10,
wherein in a planar shape of the external wiring board, a distance c from an end portion of the outermost external wiring of the external wiring board to an end surface of the chamfered portion of the external wiring board is equal to or longer than a shorter distance of either
a distance a from the end portion of the external wiring to the first end surface connected to the chamfered portion, or
a distance b from the end portion of the external wiring to the side end surface of the external wiring board.

15. The ink jet recording apparatus according to claim 10,
wherein a member of the ejection chip in which the ejection orifices are formed has, on a side facing the end portion of the external wiring board, a portion patterned into a shape similar to a planar shape of the external wiring board, and
the external wiring board is disposed to be engaged with the patterned portion.

16. The ink jet recording apparatus according to claim 15,
wherein a predetermined gap is provided between the patterned portion of the member of the ejection chip in which the ejection orifices are formed and the external wiring board, and
the gap is filled with a resin sealing material to form the resin sealing portion.

17. The ink jet recording apparatus according to claim 10,
wherein the ejection chip includes, on a substrate,
pressure-generating elements provided to correspond to the ejection orifices,
a wiring that transmits an electric signal to the pressure-generating elements, and
an extraction electrode pad electrically connected to the wiring, and the external wiring of the external wiring board is electrically bonded to the extraction electrode pad of the ejection chip via an electrode bump.

18. The ink jet recording apparatus according to claim 10,
wherein the chamfered portion is positioned within the width of the ejection orifice arrangement direction of the ejection chip, the ejection ship being adjacent to and being opposite to the first end surface.

* * * * *